United States Patent [19]
Fite

[11] 3,936,634
[45] Feb. 3, 1976

[54] METHOD AND APPARATUS FOR IMPROVED FOCUSING OF ION CURRENTS IN QUADRUPOLE MASS FILTER

[75] Inventor: Wade L. Fite, Pittsburgh, Pa.

[73] Assignee: Extranuclear Laboratories Inc., Pittsburgh, Pa.

[22] Filed: Dec. 10, 1974

[21] Appl. No.: 531,375

Related U.S. Application Data

[63] Continuation-in-part of Ser. No. 346,250, March 30, 1973, Pat. No. 3,867,632.

[52] U.S. Cl. ..... 250/281; 250/292
[51] Int. Cl.[2] ..... H01J 39/34
[58] Field of Search ..... 250/281, 282, 283, 292

[56] References Cited

UNITED STATES PATENTS

| | | | |
|---|---|---|---|
| 3,129,327 | 4/1964 | Brubaker | 250/292 |
| 3,617,736 | 11/1971 | Barnett | 250/292 |
| 3,867,632 | 2/1975 | Fete | 250/292 |

*Primary Examiner*—Craig E. Church
*Attorney, Agent, or Firm*—Mason, Mason & Albright

[57] ABSTRACT

Application of dc potentials of values other than ground to materials which appear as conductors to dc and low frequency ac electric fields and as dielectrics to high frequency ac electric fields in order to compensate for changes of potential due to ion and electron currents reaching the material and/or to provide for improved focusing of the ions, particularly with large ion currents, into a quadrupole mass filter.

22 Claims, 1 Drawing Figure

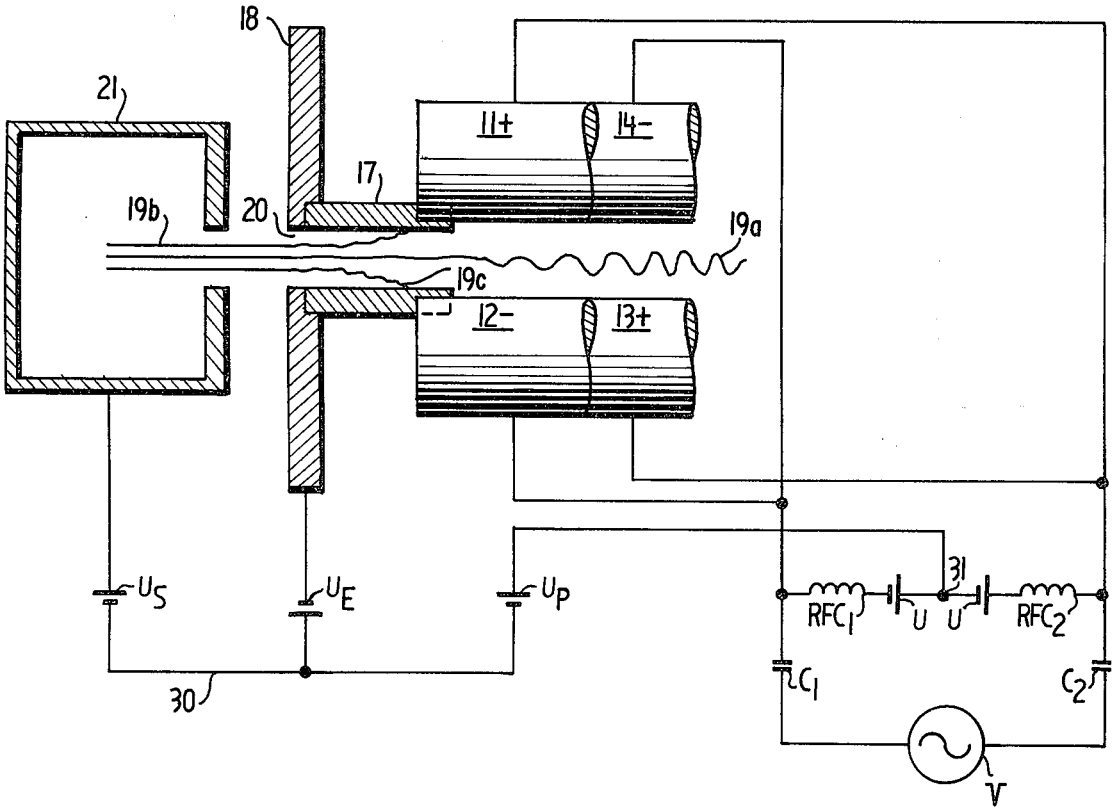
18
21
11+
14-
17
19b
20
19a
19c
12-
13+
31
$U_S$
$U_E$
$U_P$
$RFC_1$
U
U
$RFC_2$
$C_1$
$C_2$
30
V

METHOD AND APPARATUS FOR IMPROVED FOCUSING OF ION CURRENTS IN QUADRUPOLE MASS FILTER

RELATED APPLICATION

This is a continuation-in-part application of application Ser. No. 346,250 filed Mar. 30, 1973 now U.S. Pat. No. 3,867,632.

BACKGROUND TO THE INVENTION

The quadrupole mass filter of W. Paul et al described in U.S. Pat. No. 2,939,952, issued June 7, 1960, consists of four substantially parallel hyperbolic sheet electrodes (or cylindrical rods), symmetrically disposed about an axis. Opposite rods are electrically connected. On one pair of electrically connected oppositely disposed electrodes a dc voltage, U, and an ac voltage of amplitude, V, are placed. On the other pair of electrically connected oppositely disposed electrodes identical voltages, except having an electrical polarity opposite to the first pair, are placed. With proper settings of the dc voltage and the amplitude of the ac voltages, ions of a given charge-to-mass ratio have stable trajectories and oscillate about the axis whereby they do not collide with the electrodes; ions of other than the given charge-to-mass ratio are on unstable trajectories whereby they strike the electrodes. If ions are injected along the axis of the electrode structure, those with the given charge-to-mass ratio do not strike the electrodes and emerge from the opposite end of the electrode structure; however, ions with other than the given charge-to-mass ratio are accelerated in the transverse directions so that they collide with the electrodes and therefore do not emerge from the opposite end of the electrode structure. In this manner, the electrode structure functions as an ion "mass filter."

As noted in U.S. Pat. No. 3,129,327 to W. M. Brubaker of Apr. 14, 1964, an ion entering the electrode structure must pass through fringe fields near and beyond the end of the electrode structure. The ions must also pass through a similar fringe field in emerging from the opposite end of the electrode structure. As pointed out in the aforesaid patent of W. M. Brubaker, the ratio of the dc field strengths to ac field strength in the fringe fields is the same as in the electrode structure itself. Also, as disclosed in the aforesaid patent, an ion of the given charge-to-mass ratio, which is stable within the electrode structure proper, is on an unstable trajectory when it is in the fringe fields. Thus, although an ion would be stable within the electrode structure proper, it may not be received in the electrode structure proper due to its unstable trajectory in the fringe fields. This greatly reduces the transmission of ions of a given charge-to-mass ratio due to their rejection while within the fringe fields.

U.S. Pat. No. 3,129,327 further teaches that the ion trajectories can be stabilized on passage through the fringe fields provided that the ratio of the dc voltage (U) to the ac voltage amplitude (V) is reduced to a lower value than appropriate for use within the electrode structure proper. The aforesaid patent indicates several ways in which this can be accomplished in the case of quadrupole mass filters which have conventional metal electrodes. But the patent does not address itself to the broader problem of spatial separation of ac and dc fields emanating from the same metallic electrodes.

The copending patent application Ser. No. 346,250 teaches that separation of the high frequency ac fringe fields from the low frequency (including dc) fringe fields, is possible by placement of a tube or other appropriate geometrical configuration near an end or ends of a quadrupole mass filter wherein the tube is composed of a material which appears as a dielectric to the high frequency ac fringe fields and as a conductor to the low frequency (including dc) fringe fields. A required characteristic of such material is that the parameter $4\pi\sigma/\epsilon\omega$ be much less than unity in value, where $\sigma$ is the dc electrical conductivity of the material and $\epsilon$ is the material's dielectric constant. The angular frequency, $\omega$ is equal to $2\pi f$ where $f$ is the frequency of the high-frequency ac fields.

Materials having the necessary physical characteristics exist and are readily available. Among such materials is a Nickel-zinc type ferrite manufactured by Stackpole Carbon Company of St. Mary's, Pa., known as "Cerramag C/12, " which has a volume resistivity at 25°C. of about $3 \times 10^7$ ohm-cm and a dielectric constant at 1.0MHz of about 10. When ions or electrons or both pass inside and along the length of a tube of such material, some of said ions or electrons or both strike the tube's walls producing effectively dc electrical currents within the material which may affect the dc potential of the tube. The dc potential of the tube can thus be changed through the IR drop of such currents, so that trajectories of ions which do not strike the tube's walls but pass on into the quadrupole mass filter are affected adversely. Another nickel-zinc ferrite manufactured by Stackpole Carbon Company which may be utilized in the invention, Cerramag C/11, has a resistivity of $2 \times 10^7$ ohm-cm. A still further substance which has been tested and found operable is slate, the test sample having a resistivity of $1.0 \times 10^6$ ohm-cm along two axes and $2.2 \times 10^6$ ohm-cm along the third axis. The dielectric constant of slate is 6.0–7.5. The basic formula for the ferrites, Cerramag C/12 and Cerramag C/11, may be found in the patent of Zerbes U.S. Pat. No. 3,036,009 wherein other characteristics of the ferrite not important to the instant invention are discussed.

It is essential that the shield in the instant invention must appear to high-frequency ac fields as a dielectric and to low frequency, including direct current, fields as a conductor. Thus, for frequencies on the order of 1 megahertz, the resistivity must be substantially greater than $10^5$ ohm-cm. However, the materials utilized for the shielding effect are to be contrasted with good dielectrics which have resistivities of $10^{12}$ ohm-cm and higher. It is important that the resistivity of the material be not so high as to be unable effectively to conduct away current caused by ions or electrons which may strike the material during their transmission or receipt therein. Also, there are practical upper limits on the resistivity which basically relate to the sweep rate which may be utilized in the quadrupole mass filter. In this connection, it is to be understood that the substantially dc fields may be fields in a mass filter up to about 1000 Hz because this is about the limit of the sweep rate of the quadrupole mass filter. Thus, it is desirable that the material act like a conductor at a frequency up to 1000 Hz but as a dielectric at 1 million Hz. As a practical matter, materials having resistivities up to about $10^8$ ohm-cm are operable even at the maximum sweeping rate. By reducing the sweep rate and in many applications a sweep rate of about 10 Hz is all that is desirable, materials with resistivities up to about $10^{10}$ ohm-cm are operable. Still further, there are bona fide applications wherein resistivities up to about $10^{11}$ ohm-cm. However, a resistivity up to roughly $10^8$ ohm-cm offers improvement in every application of a quadrupole mass filter. From the foregoing it will be understood by those skilled in the art that the upper limit of resistivity of the shielding material varies depending upon the sweep rate desired in the mass filter, the configuration of the shield and the total ion current necessary for the shield to carry off.

SUMMARY OF THE INVENTION

The present invention relates to an improved spatial separation of fields emanating from electrodes wherein such fields are produced from superpositions of the dc or low-frequency ac and high frequency voltages placed on the electrodes, such fringe fields being produced in the vicinity of the ends of the electrode structure of a quadrupole mass filter. More particularly, the invention involves the biasing of the material affecting the spatial separation in a dc fashion away from ground potential whereby the effects of dc currents produced within the material are overcome to permit a free passage of ions into the quadrupole mass filter.

BRIEF DESCRIPTION OF THE DRAWING

Other adaptabilities and capabilities of the invention will be appreciated by those skilled in the art with reference to the following description and the drawing wherein a schematic representation of the invention is shown.

DESCRIPTION OF THE PREFERRED EMBODIMENTS

With reference to the FIGURE, a selective electric field shielding means composed of a material which is a conductor to dc and low-frequency electrical ac fields and a dielectric to high-frequency electric ac fields, is shown as tube 17, one end of which protrudes a short distance into the space between the four rods, or hyperbolic sheets, of a quadrupole mass filter, the forward two of which are designated 11+ and 12−, and the more rearwardly two as seen in the FIGURE are designated 13+ and 14−. The other end of tube 17 is mounted in an end plate 18 which is electrically conducting and in dc electrical contact with tube 17 at their juncture.

Ions produced from an ion source 21 are drawn from source 21, pass through the opening 20 in end plate 18 and enter the interior of tube 17. With tube 17 composed of material having the proper ratio of electrical conductivity to dielectric constant, as described in copending patent application Ser. No. 346,250, some ions follow trajectories such as 19*a* and enter the mass filter. These ions are those having masses greater than about 0.77 times the mass of the ions to be transmitted through the mass filter at any given setting of its fields. Ions with masses less than about 0.77 times the mass of the ions to be transmitted by the mass filter (and any electrons that might accompany the ions) are caused by the ac fields within the interior of tube 17 to strike its interior walls. Such trajectories are designated by reference characters 19*b* and 19*c*.

Inasmuch as tube 17 is constructed of a material with high resistivity within a range of above $6 \times 10^4$ to less than $10^9$ ohm-cm, typically of the order of $10^7$ ohm-cm, tube 17 has an electrical resistance. Thus the ions or electrons or both striking the interior walls of tube 17 produce electric currents which are of necessity, conducted to the circuit common 30 or ground through the tube material itself. Typical dimensions of tube 17 are about 1 or 2 centimeters in length, an interior diameter of from 2 to 6 millimeters and wall thicknesses of 2 or 3 millimeters; the total resistance of the tube is several tens of megaohms and reaches values of the order of $10^8$ ohms. Thus, with currents reaching the interior walls being as high as a few times $10^{-8}$ amperes, voltages along tube 17 of in the range of several volts result.

Referring to the electrical portions of the FIGURE, when positive ions are produced inside an ion source 21 at a potential $U_S$ with respect to the circuit common 30 potential, they have a kinetic energy of $eU_S + E_i$, $e$ being the value of the charge of the ion and $E_i$ the kinetic energy with which the ion is initially produced, at any point where the existing potential is that of the circuit common 30. In particular, if the value of $U_E$, provided by a dc voltage supply, is zero, the ions have a kinetic energy of $eU_S + E_i$ in passing through opening 20 in end plate 18. Under these circumstances, positive ions striking the interior walls of tubes 17 cause positive dc voltages to build up along the length of the tube extending into the mass filter. These voltages, if small, cause the tube to act as an unwanted lens which defocuses the ion beam in unwanted ways. Moreover, if the ion currents become sufficiently large, potentials within the tube 17 may increase to the value of $U_S$, in which case ions that would normally follow a trajectory such as 19*a* lose their kinetic energy within the tube and are not transmitted. The possibility exists that this situation may develop when end plate 18 is grounded as taught by copending patent application Ser. No. 356,250.

A solution to the problem lies in increasing the value of $U_S$ to where the ion's kinetic energy is necessarily greater than the product of the maximum current from the ion source times the resistance of tube 17 divided by the charge on the ions. However, for ion sources which produce ion currents in excess of $10^{-8}$ amperes, this solution has serious drawbacks as will be discussed.

It is customary to operate the quadrupole mass filter by applying thereto a combination of radio frequency ac voltages generated by source V of the FIGURE and dc voltages represented by the battery symbols in the FIGURE and designated U therein. Blocking condensers, $C_1$ and $C_2$, and radio frequency chokes $RFC_1$ and $RFC_2$ prevent the ac and dc voltage sources from shorting each other out and permit application of both the ac and dc voltages to the four poles 11 + 12 −, 13 + and 14 −.

It is also usual to include two voltage sources of equal values, sources U on either side of a point 31. By this means, the dc potential at the axis of the mass filter is the same as the potential, $U_{31}$ at point 31.

The kinetic energy of the ions during their passage through the mass filter is given by $E_i$ plus the ion charge, $e$ times $(U_S - U_{31})$, both potentials $U_S$ and $U_{31}$ being measured with respect to the circuit common. If $U_S$ is increased to excessively high values, the ion kinetic energy during passage through the mass filter is increased to the point where the ion executes too few oscillations at the ac frequency within the mass filter to permit the mass filter to provide good mass resolution. Raising the potential $U_S$ to the values required to overcome the voltages on tube 17 in the case of large ion currents leads to having excessive ion energy within the mass filter under these normal operating conditions.

With an understanding of the foregoing two improved solutions are presented:

The first is to place end plate 18 not at the circuit common potential but at a lower dc potential $U_E$ as represented by by the battery symbol in the FIGURE. Because it is only the potential difference $U_S$–$U_E$ which determines whether ions pass through the tube 17, the difference can be made large by increasing $U_E$ while holding $U_S$ at a low enough value to give the required low energy of the ions in passing through the mass filter. Referring to the FIGURE, this solution is appropriate to having the pole potential $U_P$ be zero, so that the potential of the mass filter axis, which is equal to $U_{31}$, is at the potential of the circuit common.

A second solution is to let the potential of the end plate 18 be the same as the circuit common, by letting the value of $U_E$ be zero. This requires that the value of $U_S$ be relatively high in order to have ions be able to be transmitted through the tube 17. However, by placing potential $U_P$ at a value slightly less than the value of $U_S$, the ions are slowed down to a low energy, $e(U_S–U_P)$, for their passage through the mass filter, which may be sufficiently low to obtain good resolution in the mass filter.

Either solution or both in combination have been used with success.

Where negative ions rather than positive ions are involved, the same solutions to the problem are applicable by merely reversing the signs of the potentials $U_S$, $U_E$, and $U_P$.

Tests have been conducted using an Extranuclear Laboratories quadrupole mass filter, Model 324-9, which has poles ¾ inch diameter. A tube 17 of Ceramag C/12, of length 1.5 cm, outside diameter of 1.2 cm and inside diameter 0.6 cm, and with an end-to-end resistance of $6 \times 10^7$ ohms, was mounted on a stainless steel end plate 18 by means of pressing tube 17 into a recess that was cut into the end plate. An electron impact ionization source, Extranuclear Laboratories, Model 041-1, was used to make both positive and negative ions. The positive ion currents produced by this ionizer are in excess of 10 milliamperes per torr of gas being ionized, so that when operating in a vacuum of $10^{-5}$ torr, a current of $10^{-7}$ amperes is caused to pass through tube 17. Most of this current is from ions of low mass ranging from 12 through 18 amu (carbon ions through water ions) and from 28 through 44 amu (nitrogen carbon dioxide). When the mass filter is set to examine ions at higher masses, such as mercury ions at 200 amu, the ac fields within tube 17 cause the lighter ions, which constitute almost all of the $10^{-7}$ amps of ions coming from the ionizer to strike the interior walls of tube 17. This current, being carried to the end plate through the tube material, theoretically caused the potential within the tube to increase to about $6 \times 10^7$ ohms times $10^{-7}$ amps, or 6 volts.

In the first test, both the potentials of the end plate 18 and of the mass filter axis were placed at ground potential by grounding the circuit common and setting $U_E = U_P = 0$. It was found that to cause any ions to pass through the mass filter, it was necessary to set the ion source potential $U_S$ in excess of 8 volts. By reducing the total ion current coming from the source through using a reduced electron current, and thus reducing the total current of ions reaching the interior of tube 17, it was found that $U_S$ could be reduced to as low as 1 volt, and still cause ions to pass through the mass filter. Under the first circumstances it is calculated that of the minimum 8 volts required, some 2 volts were required to compensate for electron space charge within the ionizer and the remaining 6 volts are attributed to voltages built up in the tube 17 by ion currents reaching its interior walls.

It was also found that at the 8 volts value of $U_S$ the shape of the mass peaks and their resoluton showed the typical effects of having an excessive ion energy for transmission through the mass filter.

Two further tests were then performed. In the first the potential of the axis of the mass filter was increased by application of positive voltage $U_P$. It was found that $U_P$ could be increased to approximately 6 volts without appreciable loss of ion current and that such increases improved the shapes of the mass peaks and the resolution.

In the second test the mass filter axis was again placed at ground potential, by making $U_P = 0$, and the ion source potential placed at $U_S$ was 2 volts. A negative potential $U_E$ was then applied to the end plate 19. It was found that to cause ion current to pass through the mass filter, it was necessary that the value of $U_E$ be at least 6 volts negative. Under these conditions the mass peaks showed both good shape and good resolution as expected for the low energy of the ions during transmission through the mass filter. Making the magnitude of $U_E$ less than 6 volts away from ground seriously reduced the transmitted ion current. Making the magnitude of $U_E$ greater than 6 volts away from ground has only minor effects on the ion current and virtually no effect on the peak shape and resolution of the mass filter. These observations are interpreted as confirming the theory described above.

In a second set of tests, negative ions were produced in the source. The negative ion examined was $0^-$ produced by dissociative attachment of electrons of $0_2$ molecules. This process has its maximum cross-section at an electron energy of about 6.5 eV, and this was the energy of the electrons used in the tests. At this low energy, the accelerating fields of the ion source used to extract the negative ions also cause some of the electrons to be extracted so that the ion beam presented to the mass filter is a mixture of negative ions and electrons with the vast majority of the particles being electrons.

It was found that with the axis of the mass filter at ground potential and with the end plate 18 grounded, under certain ion optics tuning conditions it was necessary to raise the potential $U_S$ of the ion source to a value of −20 volts in order to observe ions transmitted by the mass filter. At this potential, the peak shapes and mass resolution of the emerging ions were seriously distorted in a manner characteristic of excess ion energy. It was found that placing a bias voltage at $U_P$ of a −15 volts considerably improved the peak shapes and resolution without engendering a loss of $0^-$ ion current in accordance with the theory.

Having thus described my invention, what I claim as new and desire to secure by Letters Patent of the U.S. is:

1. In a method of mass analysis which utilizes a quadrupole mass filter and comprises the steps of producing positive ions with an initial kinetic energy $E_i$ from an ion source having an electrical potential $U_S$, introducing said ions into the space between the poles of the quadrupole mass filter wherein the electric potential along the axis of said poles is $U_P$, causing the transmission of only those ions of a selected mass-to-charge ratio through the space between said poles, providing a selective shielding at at least one end of said poles which functions substantially as a conductor to the substantially dc fields and substantially as a dielectric to ac fields, said shielding having an electric connection at a potential of $U_E$, and maintaining said potential $U_E$ less than said potential $U_P$, and said potential $U_P$ less than said potential of $U_S$ plus $E_i/e$ where $e$ is the charge of the ion.

2. A method in accordance with claim 1, wherein said potential $U_E$ is maintained at a ground potential and both said potentials $U_S + E_i/e$ and $U_P$ are maintained positive with respect to ground.

3. A method in accordance with claim 1, wherein said potential of the mass filter axis $U_P$ is set to ground potential and said potential $U_E$ is maintained negative and said potential $U_S + E_i/e$ is maintained positive with respect to ground potential.

4. A method in accordance with claim 1, wherein the ions are produced initially at rest whereby $E_i = 0$.

5. A method in accordance with claim 4, wherein the ions are produced by electron impact ionization.

6. A method in accordance with claim 4, wherein the ions are produced by photo-ionization.

7. In a method of mass analysis which utilizes a quadrupole mass filter and comprises the steps of producing negative ions with an initial kinetic energy $E_i$ from an ion source having an electric potential $U_S$, introducing said ions into the space between the poles of the quadrupole mass filter wherein the electric potential along the axis of said poles is $U_P$, causing the transmission of only those ions of a selected mass-to-charge ratio through the space between said poles, providing a selective shielding of at least one end of said poles which functions substantially as a conductor to the substantially dc fields and substantially as a dielectric to the ac fields, said shielding having electric connection at a potential of a $U_E$, and maintaining in the negative charge sense said potential $U_E$ less than said potential $U_P$, and $U_P$ less than said potential $U_S + E_i/e$ where $e$ is the charge on the ion.

8. A method in accordance with claim 7, wherein said potential $U_E$ is maintained at ground potential and both said potentials $U_S + E_i/e$ and $U_P$ are maintained negative with respect to ground.

9. A method in accordance with claim 7, wherein the potential of the mass filter axis $U_P$ is set to ground potential and said potential $U_E$ is maintained positive and said potential $U_S + E_i/e$ is maintained negative with respect to ground potential.

10. A method in accordance with claim 7, wherein the ions are produced initially at rest whereby $E_i = 0$.

11. A method in accordance with claim 10, wherein the ions are produced by electron impact ionization.

12. A method in accordance with claim 10, wherein the ions are produced by photo-ionization.

13. A device for improving the efficienty of injection and/or transmission of ions passing through a quadrupole mass filter, said device comprising an ion source having an electric potential $U_S$, means for producing ions from said ion source having an initial kinetic energy of $E_i$, a selective shielding at at least one end of the poles of the quadrupole mass filter adapted to receive said ions therethrough, said shielding functioning substantially as a conductor to the substantially dc fields and substantially as a dielectric to the ac fields produced by said poles, said shielding having electric connection to a potential of $U_E$, means for causing the transmission of said ions through said quadrupole mass filter, means for maintaining an electric potential along the axis of said poles of $U_P$, and biasing means in said quadrupole mass filter for maintaining said potential $U_E$ less than said potential $U_P$ and said potential $U_P$ less than said potential $U_S + E_i/e$ wherein $e$ is the charge on the ion.

14. A device in accordance with claim 13, wherein said ion source produces positive ions and said potential $U_E$ is maintained less than said potential $U_P$ and said potential $U_P$ is maintained less than said potential $U_S + E_i/e$ in the positive sense.

15. A device in accordance with claim 14, wherein said biasing means is adapted to maintain said potential $U_E$ at ground potential and both said potentials $U_S + E_i/e$ and $U_P$ at positive potential with respect to the ground.

16. A device in accordance with claim 14, wherein said means for establishing said potential $U_P$ is set to ground potential and said biasing means maintains said potential $U_E$ negative and said potential $U_S + E_i/e$ positive with respect to ground potential.

17. A method in accordance with claim 13, wherein said means for producing ions produces said ions at rest whereby $E_i = 0$.

18. A device in accordance with claim 17, which includes electron impact ionization means for producing said ions.

19. A device in accordance with claim 17, including photo-ionization means wherein said ions are produced by photo-ionization.

20. A device in accordance with claim 13, wherein said ions source produces negative ions and said biasing means maintains said potential $U_E$ less than said potential $U_P$ and said potential $U_P$ less than said potential $U_S + E_i/e$ in the negative sense.

21. A device in accordance with claim 20, wherein said biasing means maintains said potential $U_E$ at ground potential and both said potentials $U_S + E_i/e$ and $U_P$ are maintained negative with respect to the ground.

22. A device in accordance with claim 20, wherein said means for establishing the potential for the mass filter axis $U_P$ maintains such potential at ground potential and said biasing means is adapted to maintain said potentials $U_E$ and $U_S + E_i/e$ negative with respect to ground potential.

* * * * *